US005547769A

United States Patent [19]

Schmitz

[11] Patent Number: 5,547,769

[45] Date of Patent: Aug. 20, 1996

[54] METHOD AND COATING FOR PROTECTING AGAINST CORROSIVE AND EROSIVE ATTACKS

[75] Inventor: Friedhelm Schmitz, Dinslaken, Germany

[73] Assignee: Siemens Aktiengesellschaft, Munich, Germany

[21] Appl. No.: 417,006

[22] Filed: Apr. 5, 1995

Related U.S. Application Data

[63] Continuation of PCT/EP93/02534, Sep. 17, 1993.

[30] Foreign Application Priority Data

Oct. 5, 1992 [EP] European Pat. Off. ..... 92116998

[51] Int. Cl.[6] ..... B32B 15/18; C22F 1/04; F01D 5/28

[52] U.S. Cl. ..... 428/653; 148/518; 148/531; 148/537; 416/241 R

[58] Field of Search ..... 428/653, 629; 148/518, 531, 537; 416/241 R

[56] References Cited

U.S. PATENT DOCUMENTS

| | | | |
|---|---|---|---|
| 4,275,124 | 6/1981 | McComas et al. | 428/564 |
| 4,350,540 | 9/1982 | Allegra et al. | 428/653 |
| 4,471,033 | 9/1984 | Fukuoka et al. | 428/653 |
| 4,517,229 | 5/1985 | Nickola et al. | 428/653 |
| 5,120,613 | 6/1992 | Basler et al. | 428/653 |

FOREIGN PATENT DOCUMENTS

| | | |
|---|---|---|
| 0204423 | 12/1986 | European Pat. Off. . |
| 0048406 | 4/1989 | European Pat. Off. . |
| 0379699 | 8/1990 | European Pat. Off. . |
| 681250 | 10/1952 | United Kingdom . |
| 706739 | 4/1954 | United Kingdom . |
| 716554 | 10/1954 | United Kingdom . |

OTHER PUBLICATIONS

Metals Handbook, vol. 4, 9th ed., Nov. 1981, pp. 675–676, 700–701.

Galvanotechnik, vol. 73, No. 1, Jan., 1982, pp. 2–8, (Suchentrunk et al.).

Zeitschrift Für Werkstofftechnik, vol. 17, 1986, pp. 413–418, (Hoffmann et al.).

Werkstoffe Und Korrosion, vol. 41, 1990, pp. 623–634 (Schmitt–Thomas et al.).

Praxis Der Kraftwerkchemie, Vulken–Verlag, 1986, pp. 574–591 (Schmitz).

Metalloverflache, vol. 45, 1991, No. 8, pp. 369–373, (Paatsch).

*Primary Examiner*—John Zimmerman
*Attorney, Agent, or Firm*—Herbert L. Lerner; Laurence A. Greenberg

[57] ABSTRACT

A method and a coating are provided for attaining protection of a substrate being formed of chromium steel for a component of a turbomachine, against at least one of corrosive and erosive attack at a temperature up to approximately 500° C. An aluminum-containing metal coating is applied to the substrate. At least the surface of the metal coating is hardened or age-hardened to form a protective coating containing aluminum.

15 Claims, No Drawings

METHOD AND COATING FOR PROTECTING AGAINST CORROSIVE AND EROSIVE ATTACKS

CROSS-REFERENCE TO RELATED APPLICATION

This application is a Continuation of International application Ser. No. PCT/EP93/02534, filed Sep. 17, 1993.

BACKGROUND OF THE INVENTION

Field of the Invention

The invention relates to a method and a coating for protecting a chromium steel substrate of a component of a turbomachine against corrosive and erosive attacks at temperatures up to approximately 500° C., wherein the protective coating contains aluminum.

More particularly, the invention relates to substrates on components for all types of turbomachines, especially turbocompressors, regardless of how they are driven, and to gas and steam turbines, with particular reference to components of turbomachines of the kind that are supposed to be operated at temperatures of up to approximately 500° C. An especially important field to which the invention applies is the protection of compressor blades and other components which are stressed like them, in the turbocompressors of gas turbines.

Some possibilities for protecting a substrate of a component of a turbomachine against corrosive and erosive attacks at temperatures up to 450° C. are disclosed in Patent European Application 0 379 699 A1 (corresp. to U.S. Pat. No. 5,120,613). In that disclosure, blades for turbine machines, which are predominantly made of ferritic and/or ferritic/martensitic basic materials, are provided with protective coatings of aluminum alloys, especially aluminum alloys containing from 6 to 15 weight % silicon. Such aluminum alloys are to be applied to the blades by a high-speed spraying process.

The phenomenon of vibration-induced corrosion cracking on coated compressor blades for turbomachines has been addressed in detail in the article by H. Hoffmann, W. Magin, M. Schemmer and F. Schmitz entitled "Schwingungsriβkorrosion beschichteter Verdichterschaufel-Werkstoffe" [Corrosion Fatigue in Coated Compressor Blade Materials], in Zeitschrift für Werkstofftechnik [Journal for Materials Science] 17 (1986) 413. The compressor blades mentioned in that article have protective coatings made of aluminum pigments dispersed in chromate/phosphate binders, on substrates of chromium steels. Protective coatings of nickel or nickel-cadmium alloys are also mentioned.

The problem of erosive attacks, to which compressor blades and the like are exposed, is discussed in detail in the article by K. G. Schmitt-Thomas, T. Happle and P. Steppe entitled "Untersuchung der Strahlverschleiβbeständigkeit von Werkstoffen und Beschichtungen mit Hilfe eines Wirbelbett-Testverfahrens" [Investigation into the Blasting Wear Resistance of Materials and Coatings Using Fluidized-Bed Process], in Werkstoffe und Korrosion [Materials and Corrosion] 41 (1990) 623. That article also addresses the interaction of erosion and corrosion in turbomachine blades, since abrasion in a protective coating occurring due to erosion finally lays bare the substrate of a blade which has a material that is typically essentially optimized only for mechanical properties, and does not have adequately good resistance to erosion and corrosion. The mechanisms of erosion, which depend especially on the angles at which eroding particles strike a component, are discussed at length and the dependency of the effect of the erosion on the type of material being exposed to the erosion is also addressed. Erosion and corrosion problems of compressor blades, especially compressor blades with inorganically bound aluminum pigment coatings, which may possibly be provided with inorganic or organic cover coatings, are described in detail.

The book entitled "Praxis der Kraftwerk-Chemie" [Power Plant Chemistry in Practice], published by Hans-Günther Heitmann, Vulkan-Verlag, Essen, 1986, and especially the article in it entitled "Gasturbinen-Anlagen" [Gas Turbine Systems] by F. Schmitz, pp. 574 ff., also provide important information on the problems of corrosive and erosive attacks in the compressors of gas turbine systems. Details on the erosive and corrosive attacks, and especially on vibration-induced corrosion cracking, and on the problems that occur when typical high-temperature-lacquer protective coatings are used, are also discussed. In that connection, corrosion phenomena, which begin at pores in the protective coatings and can cause damage to the basic materials beneath protective coatings that appear superficially to be more or less intact, should be mentioned.

The article entitled "Korrosionverhalten von anodisch oxidierten Aluminium-Werkstoffen" [Corrosive Behavior of Anodically Oxidized Aluminum Materials] by W. Paatsch, Metalloberfläche [Metal Surface] 45 (1991) 8, provides information on corrosion phenomena in aluminum surfaces that have been anodically oxidized. Anodic oxidation of aluminum is known in many fields in the industry, although not in connection with turbomachines, for forming sturdy, decorative surfaces. That article is silent on the problems of erosion and load-bearing ability of an aluminum surface at elevated temperature.

SUMMARY OF THE INVENTION

It is accordingly an object of the invention to provide a method and a coating for protecting against corrosive and erosive attacks on a chromium steel substrate, such as a component of a turbomachine, at temperatures up to approximately 500° C., which overcome the hereinaforementioned disadvantages of the heretofore-known methods and products of this general type, which attain substantially improved protection for a substrate being formed of chromium steel for a component of a turbomachine, and moreover in which the expense for attaining such protection is kept low and if possible even reduced.

With the foregoing and other objects in view there is provided, in accordance with the invention, in a method for attaining protection of a substrate being formed of chromium steel for a component of a turbomachine, against at least one of corrosive and erosive attack at a temperature up to approximately 500° C., the improvement which comprises applying an aluminum-containing metal coating to the substrate, and hardening or age-hardening or dispersion or precipitation hardening at least a surface of the metal coating to form a protective coating containing aluminum.

The invention is based on the recognition that the hardenability or age-hardenability of aluminum itself, or of the aluminum-based materials, can be advantageously exploited to form a protection of the type referred to above. The hardening of the aluminum-containing metal coating may be performed chemically, for instance, in particular by oxidation, or mechanically, in particular by rolling. The term age-hardening is understood, for instance, to mean a change caused by heat treatment in the microstructure of the metal coating, in particular a precipitation hardening. The hardening or age-hardening need not necessarily engage the entire metal coating. It can certainly be advantageous to limit the hardening or age-hardening to a portion near the surface and thus to obtain a so-called "duplex coating". The hard coating formed according to the invention advantageously has a Vickers hardness HV 0.025 of more than approximately 200, which is substantially more than HV 0.025 of a conventional high-temperature-lacquer coating, where HV 0.025 typically amounts to 120 at most.

In accordance with another mode of the invention, the metal coating to be applied to the substrate that is to be protected is primarily formed of aluminum and accordingly is in particular an aluminum-based alloy, for instance with an additive of at least one of the elements in the group consisting of magnesium, copper and zinc. Silicon, manganese and titanium are possible as further additives.

In accordance with a further mode of the invention, the hardening or age-hardening of the metal coating is effected in such a way that the metal coating is converted, at least at its surface, into a hard coating. As already indicated, the hard coating may be produced by numerous different processes which may optionally be combined with one another, in particular mechanical work hardening, or chemical or thermal treatment.

In accordance with an added mode of the invention, a portion of the metal coating remains beneath the hard coating, so that the protective coating is a duplex coating which includes both the metal coating and the hard coating. In view of the erosion attack, which is dependent on the alignment of the attacked regions of the substrate relative to the path direction of eroding particles, a duplex coating which on one hand includes a harder coating and on the other hand includes a more ductile metal coating is especially favorable, since hard coatings and ductile coatings each resist different types of erosion: Hard coatings are suitable as protection against an erosive attack by particles that strike it at an angle ranging from a glancing angle to an approximately oblique angle, while ductile metal coatings are advantageous for protection against erosion by particles that strike it at large angles, in particular obliquely to approximately perpendicularly. The duplex coating is thus capable of assuring protection against eroding particles regardless of their angle of arrival, although initially at some regions of the component, where the particles arrive approximately vertically, some abrasion of the hard coating must be expected, until the ductile metal coating that is resistant to erosion at large angles of incidence is laid bare.

In accordance with an additional mode of the invention, the hard coating is formed by at least partial oxidation of the metal coating. Preferably the oxidation is an anodic oxidation.

In accordance with yet another mode of the invention, following an anodic oxidation, the hard coating which is obtained can be additionally densified, by being treated with boiling water or a boiling aqueous salt solution. Details regarding this treatment are known in the field of anodic oxidation of aluminum and require no further explanation herein. Through the use of any kind of oxidation of an aluminum-containing coating, a surface coating is produced that has aluminum oxide or corundum as its essential ingredient, which is one of the hardest minerals in existence. In order to achieve an especially thick, dense and hard coating, anodic oxidation is especially suitable. It should be pointed out that for the anodic oxidation, not only coatings of substantially pure aluminum but also and in particular coatings of aluminum-magnesium alloys, are possible. In particular, aluminum-based alloys with an additive of magnesium in a proportion by weight of between 0.5% and 5%, and in particular between 1% and 4%, are suitable, optionally with further slight proportions of silicon, iron, copper, chromium, zinc and/or titanium in the usual range.

In accordance with yet a further mode of the invention, an alternative method for forming a hard coating on a metal coating is to use an age-hardenable alloy to form the metal coating, with ensuing age-hardening. The age-hardening may be limited to a region near the surface of the metal coating, for instance by accomplishing the age-hardening by irradiation with laser light. It may also encompass the entire metal coating, for which purpose the component provided with the metal coating can be heat-treated in the usual way in a stove.

In accordance with yet an added mode of the invention, an aluminum-based alloy with additives of magnesium as well as copper or zinc is particularly possible as an age-hardenable alloy. Advantageously, an aluminum-based alloy is used that has proportions by weight of magnesium between 0.4 and 2%, as well as copper between 3.5 and 5%, with typical contaminants and possibly other admixtures, as noted above. Likewise possible is an aluminum-based alloy with proportions by weight of zinc between 1% and 5%, and in particular between 4% and 5%, as well as magnesium up to 2% and in particular between 1% and 1.5%, again with typical contaminants and optional further admixtures.

In accordance with yet an additional mode of the invention, it is generally advantageous, for forming the protection against corrosive and erosive attacks at temperatures up to approximately 500° C., to apply the metal coating to the substrate with the coating having a thickness that is between 15 μm and 200 μm, and preferably between 40 μm and 100 μm.

In accordance with again another mode of the invention, the application of the metal coating is especially advantageously performed, in the context of any embodiment of the method, electrochemically and in particular by electroplating. Electroplating attains an especially uniform, dense coating with extremely low porosity, in which the occurrence of pitting corrosion is accordingly suppressed. Pitting corrosion occurs whenever an electrically conductive liquid, such as a water droplet with salt or ash contained in it, gets into a pore of the protective coating and forms a galvanic element with the protective coating and the substrate. The processes of decomposition that occur in such an element can begin at the pore and propagate into the boundary coating between the protective coating and the substrate and can destroy the substrate underneath the superficially intact protective coating. For this reason, the electrochemical application of the metal coating is especially preferred, since it avoids pores.

In accordance with again a further mode of the invention, the protective coating of any embodiment is applied directly to the substrate, that is without the interposition of any intermediate coatings. As a result, the effort and expense involved in attaining the protection is in particular kept low.

With the objects of the invention in view, there is also provided, in combination with a substrate being formed of chromium steel for a component of a turbomachine offering protection against at least one of corrosive and erosive attack at a temperature up to approximately 500° C., a protective coating on the substrate, comprising an aluminum-containing metal being applied to the substrate and having a surface being hardened or age-hardened.

The invention accordingly also relates to a substrate which is provided with a protective coating according to the invention as a protection against a corrosive and/or erosive attack at a temperature up to approximately 500° C.

In accordance with another feature of the invention, such a substrate can in particular belong to an airfoil-shaped part of a component of a turbomachine, such as a turbocompressor, whether it is a rotating blade or a stationary vane.

In accordance with a further feature of the invention, the component has a root part for securing the component and an airfoil-shaped part, which in the context of the thermodynamic process in the turbomachine is the operative part, and wherein at least the airfoil-shaped part, which is exposed to a gas, in particular air, gas turbine gas or steam, has a substrate protected in accordance with the invention.

In accordance with an added feature of the invention, the substrate is formed of steel having the following ingredients, where the ingredients are indicated in weight percents:

| | |
|---|---|
| 0.1 to 0.3% | carbon |
| 11 to 17% | chromium |
| 0 to 6% | nickel |
| 0 to 1.5% | molybdenum |
| 0 to 1% | vanadium |
| 0 to 1% | silicon |
| 0 to 1% | manganese |

with the rest being iron and intrinsically unavoidable or production-dictated contaminants.

In accordance with a concomitant feature of the invention, the substrate being protected according to the invention has at least in part has a ferritic or martensitic structure or microstructure.

Other features which are considered as characteristic for the invention are set forth in the appended claims.

Although the invention is illustrated and described herein as embodied in a method and a coating for protecting against corrosive and erosive attacks on a chromium steel substrate at temperatures up to approximately 500° C., it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific examples:

Examples of chromium steels that are possible for substrates to be protected according to the invention are the chromium steels known as X20 Cr 13, X20 CrMoV 12 1, X20 CrNiMo 15 5 1, X12 CrNiMo 12. The chromium steel X20 Cr 13 is considered to be especially preferred.

The invention relates to the attainment of protection for a substrate, especially a substrate of a turbine blade or compressor blade of a turbomachine, against a corrosive and/or erosive attack at a temperature up to approximately 500° C. A protective coating that contains aluminum is formed on the substrate. According to the invention, first an aluminum-containing metal coating is applied and is hardened or age-hardened at least on its surface to form the protective coating. Within the scope of the invention, a highly effective protection against corrosion and erosion can be obtained by simple means.

I claim:

1. In a method for attaining protection of a substrate being formed of chromium steel for a component of a turbomachine, against at least one of corrosive and erosive attack at a temperature up to approximately 500° C., the improvement which comprises:

applying a metal coating of an age-hardenable aluminum-based alloy to the substrate, and age-hardening at least a surface of the metal coating to form a protective coating containing aluminum.

2. The method according to claim 1, which comprises forming the applied metal coating with an additive of at least one element selected from the group consisting of magnesium, copper and zinc.

3. The method according to claim 1, which comprises at least intermittently essentially completely converting the metal coating into an age-hardened protective coating.

4. The method according to claim 1, which comprises at least intermittently leaving a portion of the metal coating under the age-hardened protective coating in a non-age-hardened state.

5. The method according to claim 1, which comprises forming the metal coating of an age-hardenable aluminum-based alloy with additives of magnesium and an element selected from the group consisting of copper and zinc, and age-hardening the alloy to form an age-hardened protective coating.

6. The method according to claim 1, which comprises forming the metal coating with a thickness between 15 μm and 200 μm.

7. The method according to claim 1, which comprises forming the metal coating with a thickness between 40 μm and 100 μm.

8. The method according to claim 1, which comprises applying the metal coating electrochemically.

9. The method according to claim 1, which comprises applying the metal coating by electroplating.

10. The method according to claim 1, which comprises applying the protective coating directly to the substrate.

11. In combination with a substrate being formed of chromium steel for a component of a turbomachine and offering protection against at least one of corrosive and erosive attack at a temperature up to approximately 500° C., a protective coating on the substrate, comprising:

an aluminum-based age-hardenable alloy applied to the substrate and having an age-hardened surface.

12. The combination according to claim 11, wherein the substrate belongs to an airfoil-shaped part of the component, and the component is a blade or vane of a turbomachine or a turbocompressor.

13. The combination according to claim 11, wherein the component has a root part and an airfoil-shaped part, and the substrate belongs to the airfoil-shaped part.

14. The combination according to claim 11, wherein the chromium steel has the following proportions given in weight percents:

| | |
|---|---|
| 0.1 to 0.3% | carbon; |
| 11 to 17% | chromium; |
| 0 to 6% | nickel; |
| 0 to 1.5% | molybdenum; |
| 0 to 1% | vanadium; |
| 0 to 1% | silicon; |
| 0 to 1% | manganese; and |

a remainder of iron containing intrinsically unavoidable contaminants.

15. The combination according to claim 11, wherein the substrate has at least partially a ferritic or martensitic microstructure.

* * * * *